US009176465B2

(12) United States Patent
Fujii

(10) Patent No.: US 9,176,465 B2
(45) Date of Patent: Nov. 3, 2015

(54) IMAGE FORMING APPARATUS

(71) Applicant: KYOCERA Document Solutions Inc., Osaka-shi, Osaka (JP)

(72) Inventor: Hirokazu Fujii, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/243,777

(22) Filed: Apr. 2, 2014

(65) Prior Publication Data

US 2014/0301753 A1 Oct. 9, 2014

(30) Foreign Application Priority Data

Apr. 4, 2013 (JP) ..... 2013-078581

(51) Int. Cl.
*G03G 15/00* (2006.01)
*G03G 21/18* (2006.01)

(52) U.S. Cl.
CPC ..... *G03G 21/1821* (2013.01)

(58) Field of Classification Search
CPC ..... G03G 21/1821; G03G 21/1839
USPC ..... 399/110
See application file for complete search history.

(56) References Cited

U.S. PATENT DOCUMENTS 5,845,176 A 12/1998 Yoshida et al.
2013/0164028 A1* 6/2013 Morioka et al. ..... 399/111

FOREIGN PATENT DOCUMENTS

JP 08054786 A 2/1996
JP 11174765 A 7/1999
JP 11249529 A 9/1999

* cited by examiner

*Primary Examiner* — David Bolduc
*Assistant Examiner* — Barnabas Fekete
(74) *Attorney, Agent, or Firm* — Alleman Hall McCoy Russell & Tuttle LLP

(57) ABSTRACT

An image forming apparatus according to an aspect of the present disclosure includes a drum unit, a developing unit, a pressing unit, and a projection portion. Drum unit includes photosensitive drum. Developing unit includes a developing roller that develops a toner image on the photosensitive drum. Each of drum unit and developing unit is configured to be extractable from an apparatus body. Pressing unit is configured to make developing unit movable between a pressing position at which developing roller is pressed against photosensitive drum and a pressing-releasing position at which developing roller is separated from photosensitive drum so as to release the pressing. Projection portion is provided integrally with developing unit and configured to be projected to an extraction path of drum unit when developing unit is located at pressing position and to retract from extraction path of drum unit when developing unit is located at the pressing-releasing position.

7 Claims, 16 Drawing Sheets

IMAGE FORMING APPARATUS

INCORPORATION BY REFERENCE

This application is based upon and claims the benefit of priority from the corresponding Japanese Patent Application No. 2013-078581 filed on Apr. 4, 2013, the entire contents of which are incorporated herein by reference.

BACKGROUND

The present disclosure relates to an image forming apparatus.

Some image forming apparatuses are configured to form an electrostatic latent image on an image carrier such as a photosensitive drum, develop the electrostatic latent image using toner, and transfer the developed toner image onto a predetermined sheet material. In general, the efficiency of the maintenance work, the assembly operation and the like of such image forming apparatuses are improved by forming the photosensitive drum and the surrounding devices as one or more units and configuring the unit(s) so as to be extractable from the apparatus body.

As an example of conventional image forming apparatuses including a photosensitive drum unit that includes a photosensitive drum and is detachable from an apparatus body, a main charger body that charges the circumferential surface of the photosensitive drum, and a transfer charger body that transfers a toner image formed on the circumferential surface of the photosensitive drum onto a sheet, an image forming apparatus is known in which both the main charger body and the transfer charger body are configured to be movable between a setting position at which they are in close proximity to the photosensitive drum and a retracted position at which they are separated from the photosensitive drum.

As shown in the above-described conventional technique, the drum unit and the developing unit need to be separated from each other when these units are attached or detached. In recent years, medium-sized and large-sized image forming apparatuses are in widespread use in offices in general, and a general user who is not familiar with the apparatus configuration may perform the unit replacement operation. In such a case, the general user may be unaware of the presence of a unit separation mechanism and try to attach or detach the units in a state in which the photosensitive drum and the developing roller are pressed against each other, thereby causing scratches on the circumferential surface of the photosensitive drum.

SUMMARY

An image forming apparatus according to an aspect of the present disclosure includes a drum unit, a developing unit, a pressing unit, and a projection portion. The drum unit includes a photosensitive drum. The drum unit is configured to be extractable from an apparatus body. The developing unit includes a developing roller that develops a toner image on the photosensitive drum. The developing unit is configured to be extractable from the apparatus body. The pressing unit is configured to make the developing unit movable between a pressing position at which the developing roller is pressed against the photosensitive drum and a pressing-releasing position at which the developing roller is separated from the photosensitive drum so as to release the pressing. The projection portion is provided integrally with the developing unit and configured to be projected to an extraction path of the drum unit when the developing unit is located at the pressing position and to retract from the extraction path of the drum unit when the developing unit is located at the pressing-releasing position.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, a description will be given of an image forming apparatus according to an embodiment of the present disclosure with reference to the drawings. In the following, an XYZ orthogonal coordinate system is defined, and the positional relationships between members may be described with reference to the XYZ orthogonal coordinate system. Note that a predetermined direction in a horizontal plane is referred to as an X-axis direction, a direction orthogonal to the X-axis direction in the horizontal plane is referred to as a Y-axis direction, and a direction orthogonal to each of the X-axis direction and the Y-axis direction (i.e., the vertical direction) is referred to as a Z-axis direction.

(Schematic Configuration of Image Forming Apparatus)

Figure 1:
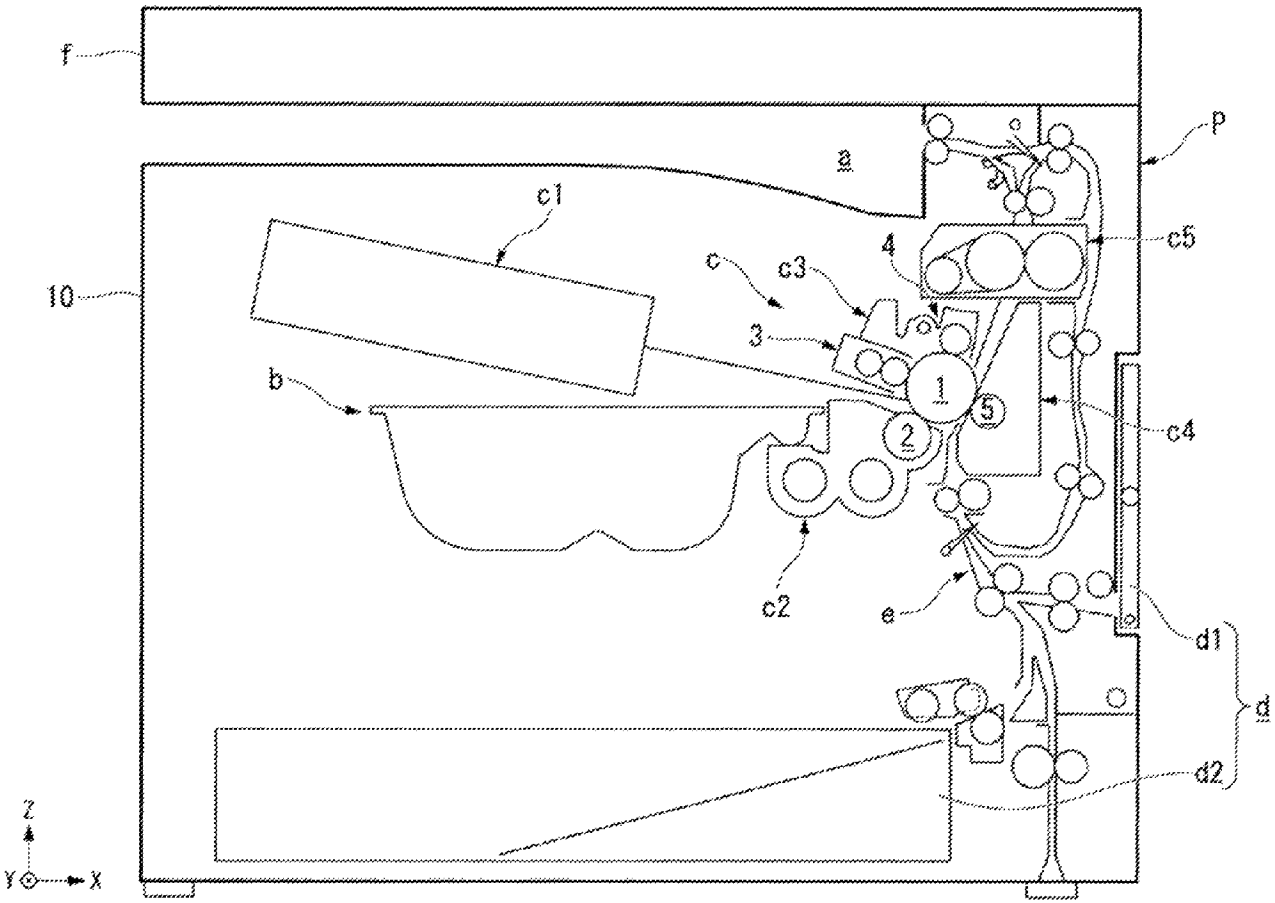
FIG. 1 is a schematic configuration diagram of a copier according to an embodiment of the present disclosure.

FIG. 1 is a schematic configuration diagram of a copier P according to an embodiment of the present disclosure. The copier (image forming apparatus) P includes a discharge portion (a), a toner storage portion (b), an image forming portion (c), and a sheet portion (d). In the copier P, a conveyance portion (e) is provided extending from the sheet portion (d) located in the lower area of the copier P to the discharge portion (a) located in the upper area. Additionally, in the copier P, a scanner portion (f) that reads an original is provided above the discharge portion (a).

The discharge portion (a) is configured such that a sheet (sheet material) on which a predetermined image has been formed is discharged via the conveyance portion (e). The bottom surface of the discharge portion (a) is inclined such that a plurality of sheets that are to be discharged can be stacked so as to be aligned on one edge thereof.

The toner storage portion (b) is constituted, for example, by a toner container for black toner (BK), and is configured to be able to supply toner to a developing unit c2 of the image forming portion (c).

The image forming portion (c) includes a laser scanning unit c1, a developing unit c2, a drum unit c3, a transfer unit c4, and a fixing unit c5.

Similarly to a well-known laser scanning unit, the laser scanning unit c1 includes an optical beam generator that generates laser light, a polygon mirror that scans the optical beam applied from the optical beam generator, and an fθ lens or the like that forms an image of the optical beam scanned by the polygon mirror (all not shown) onto a photosensitive drum (image carrier) 1, which will be described later.

The developing unit c2 develops the electrostatic latent image formed on the circumferential surface of the photosensitive drum 1 by supplying toner to the photosensitive drum 1, and includes a developing roller 2 disposed so as to be radially opposed to the circumferential surface of the photosensitive drum 1.

The drum unit c3 includes the photosensitive drum 1. On the circumferential surface of the photosensitive drum 1, an electrostatic latent image is generated using the laser scanning unit c1, and a toner image is formed using the toner supplied from the toner storage portion (b) to the developing unit c2.

Around the photosensitive drum 1, a charger 3 that brings the circumferential surface of the photosensitive drum 1 into a charged state, a cleaner 4 that removes the toner remaining on the circumferential surface after the transfer, and so forth are disposed so as to be opposed to the photosensitive drum 1. The charger 3, the cleaner 4 and so forth according to the present embodiment, together with the photosensitive drum 1, are formed into a detachable unit as the drum unit c3.

The transfer unit c4 includes a transfer roller 5 disposed so as to be radially opposed to the circumferential surface of the photosensitive drum 1. The transfer roller 5 is provided so as to be pressed against the photosensitive drum 1.

Accordingly, when the photosensitive drum 1 is rotationally driven, the transfer roller 5 can be rotated in response to this operation. Further, when a predetermined sheet material, for example, a sheet, is conveyed via the conveyance portion (e), the transfer roller 5 can be rotated in a state in which the sheet is interposed between the photosensitive drum 1 and itself, and the sheet can be conveyed toward the fixing unit c5.

The fixing unit c5 is provided in the conveyance portion (e) at a part downstream of the location where the transfer unit c4 is provided, and is composed of a pair of rollers disposed so as to nip the sheet being conveyed on the conveyance portion (e). Also, the fixing unit c5 is configured to be able to fix the toner image onto the sheet that has been transferred by the transfer unit c4 by pressurizing and heating the sheet using the pair of rollers.

The sheet portion (d) includes a paper feed tray d1 provided so as to be openable and closable with respect to the apparatus body 10 and a sheet feed cassette d2 provided so as to be extractable from the apparatus body 10. Also, the sheet portion (d) is configured to be able to feed sheets one at a time from the paper feed tray d1 or the sheet feed cassette d2 to the conveyance portion (e).

The conveyance portion (e) is provided in a region extending from the sheet portion (d) located in the lower area to the discharge portion (a) located in the upper area, and is composed of a plurality of conveyance rollers and guide plates. Also, the conveyance portion (e) is configured to be able to convey the sheets fed from the sheet portion (d) one at a time toward the discharge portion (a).

In the copier P having the above-described configuration, an electrostatic latent image is formed by applying laser light corresponding to image data onto the photosensitive drum 1 from the laser scanning unit c1, and a toner image is formed by developing the electrostatic latent image using the supplied toner. Then, the toner image carried on the photosensitive drum 1 is transferred onto a sheet by the transfer unit c4, and thereafter pressurized and heated by the fixing unit c5 for a fixing process. Finally, the sheet on which the image is printed is discharged to the discharge portion (a).

(Configuration of Apparatus Body and Various Units)

Figure 2:
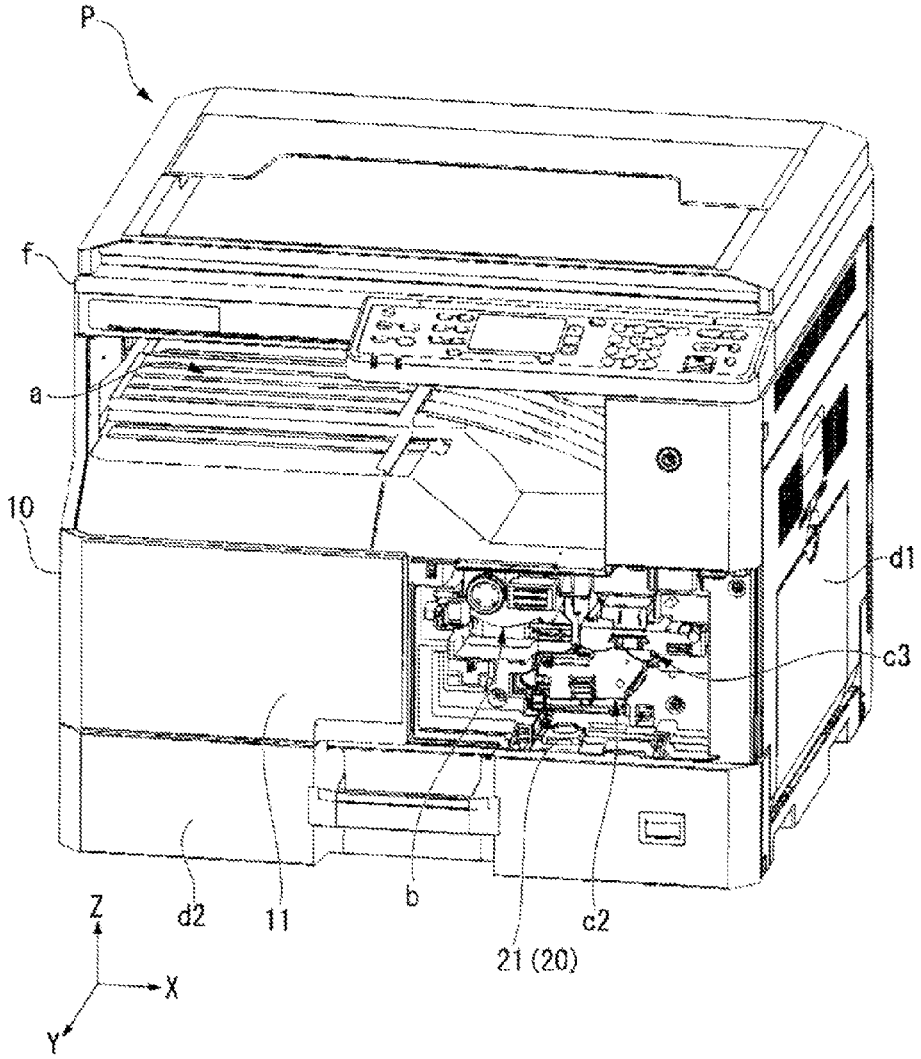
FIG. 2 is a perspective view showing the external appearance of an apparatus body according to an embodiment of the present disclosure.

FIG. 2 is a perspective view showing the external appearance of the apparatus body 10 according to an embodiment of the present disclosure. As shown in FIG. 2, when a part of the cover 11 on the front side (+Y-side) of the apparatus body 10 is opened, the developing unit c2, the drum unit c3, the toner storage portion (b) and so forth are partly exposed to the outside of the apparatus. Each of the developing unit c2 and the drum unit c3 is configured to be extractable from the apparatus body 10 to the front side by a guide (not shown). Accordingly, the photosensitive drum 1, the developing roller 2, and the members around these components can be partly removed together from the apparatus body 10 by extracting the developing unit c2 and the drum unit c3 to the front side.

Since the developing roller 2 is disposed in close proximity to the photosensitive drum 1 as shown in FIG. 1, the developing roller 2 needs to be separated from the photosensitive drum 1 when the developing unit c2 and the drum unit c3 are extracted. The copier P according to the present embodiment is configured such that the operation of limiting the extraction of the drum unit c3 and the developing unit c2 and the operation of releasing the limitation are each performed in conjunction by operating an operating lever 21 of an operation portion 20 exposed below the developing unit c2.

Figure 3:
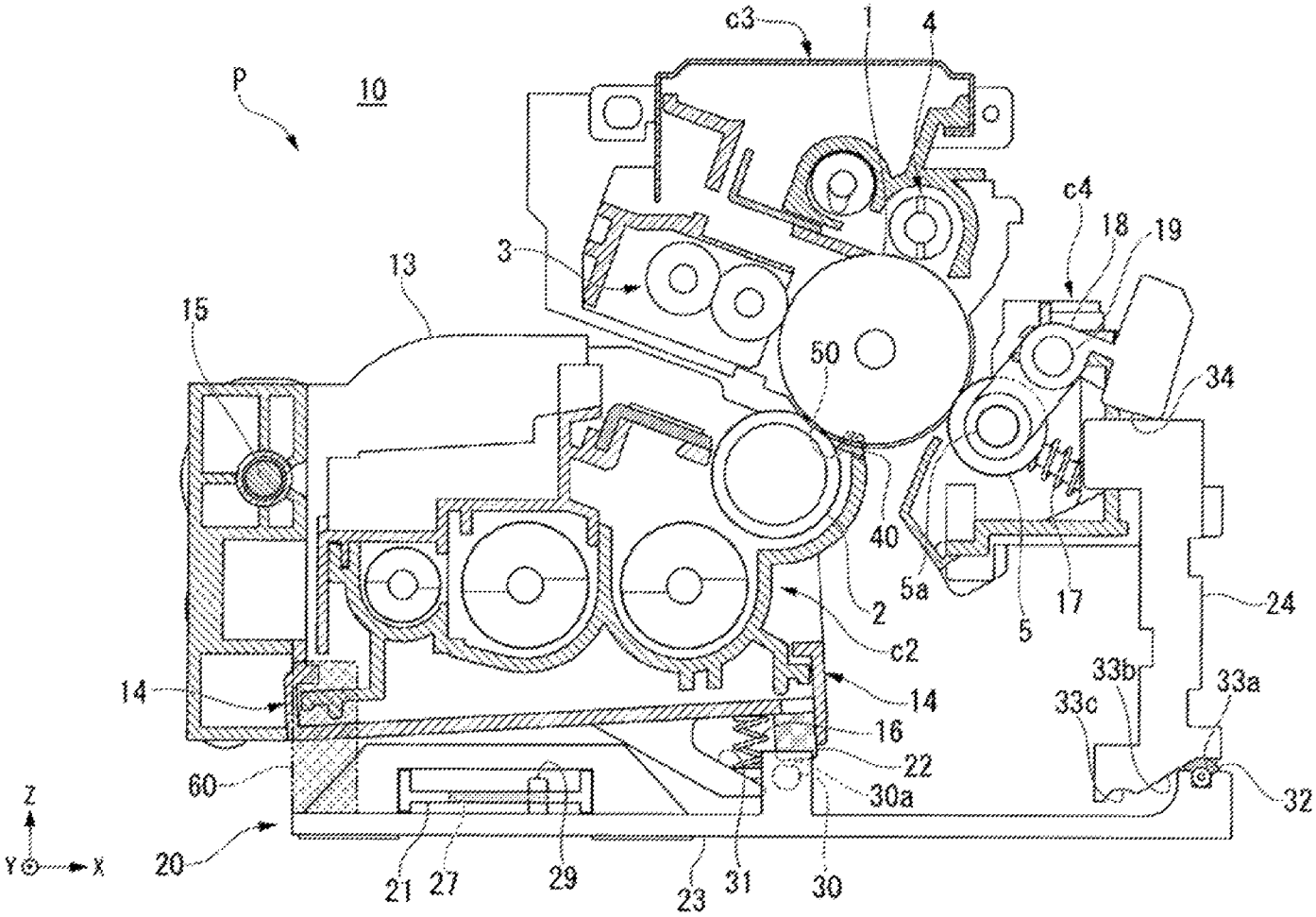
FIG. 3 is a configuration diagram showing the arrangement of various units when an operation portion is located at a first position (retracted position) according to an embodiment of the present disclosure.
Figure 4:
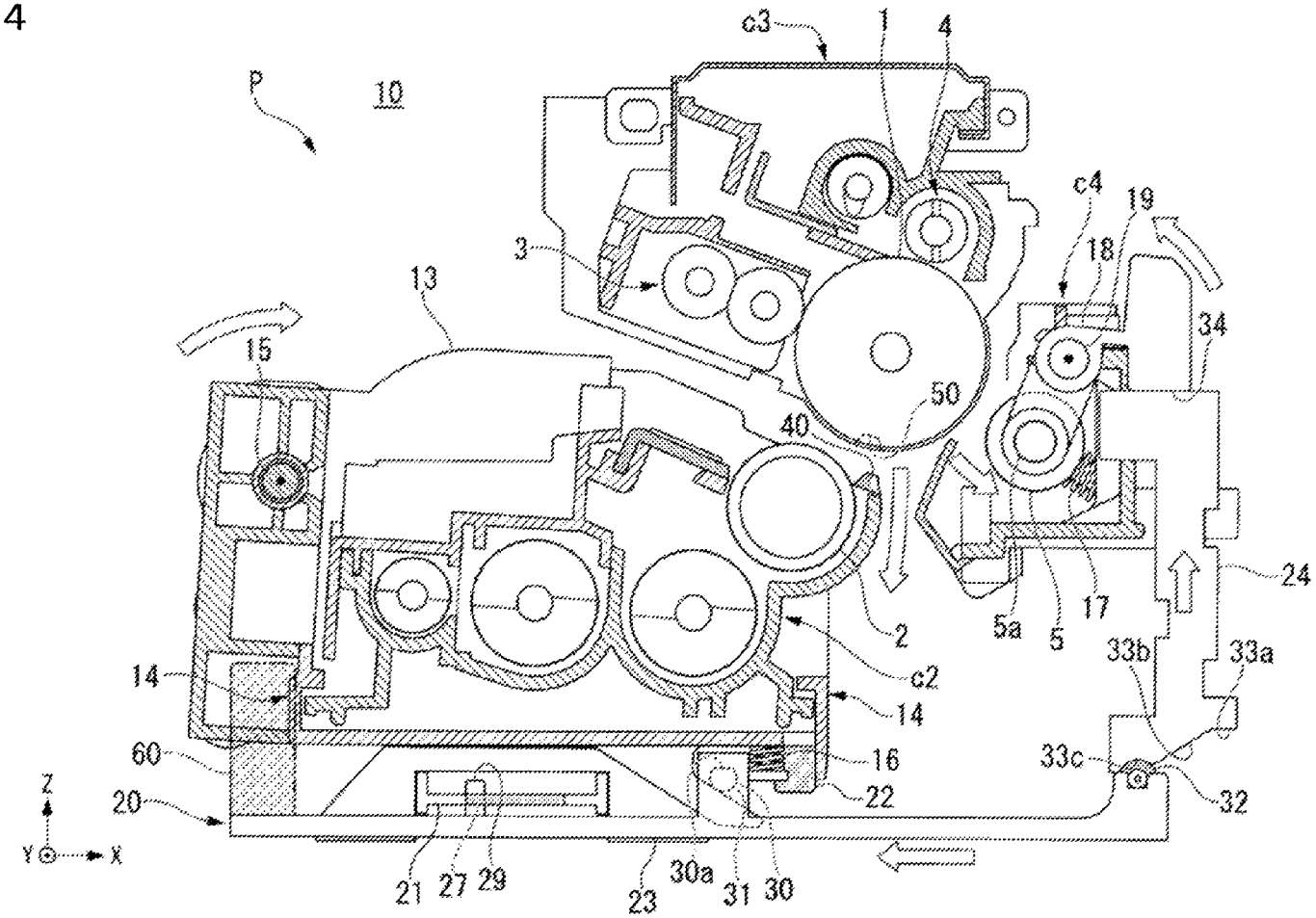
FIG. 4 is a configuration diagram showing the arrangement of the units when the operation portion is located at a second position (depressing position) according to an embodiment of the present disclosure.
Figure 5:
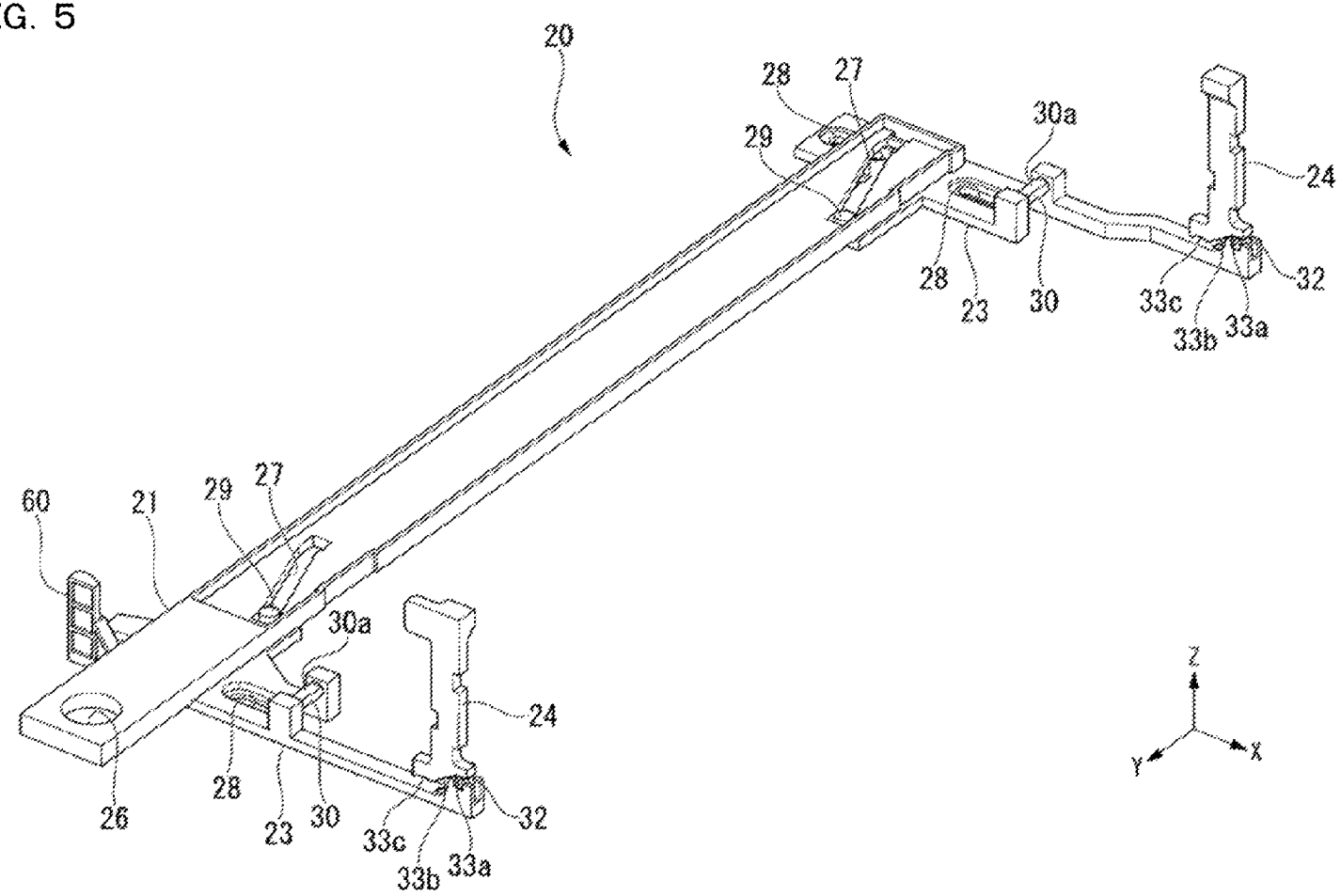
FIG. 5 is a perspective view showing the external appearance of the entire operation portion when it is located at the first position according to an embodiment of the present disclosure.
Figure 6:
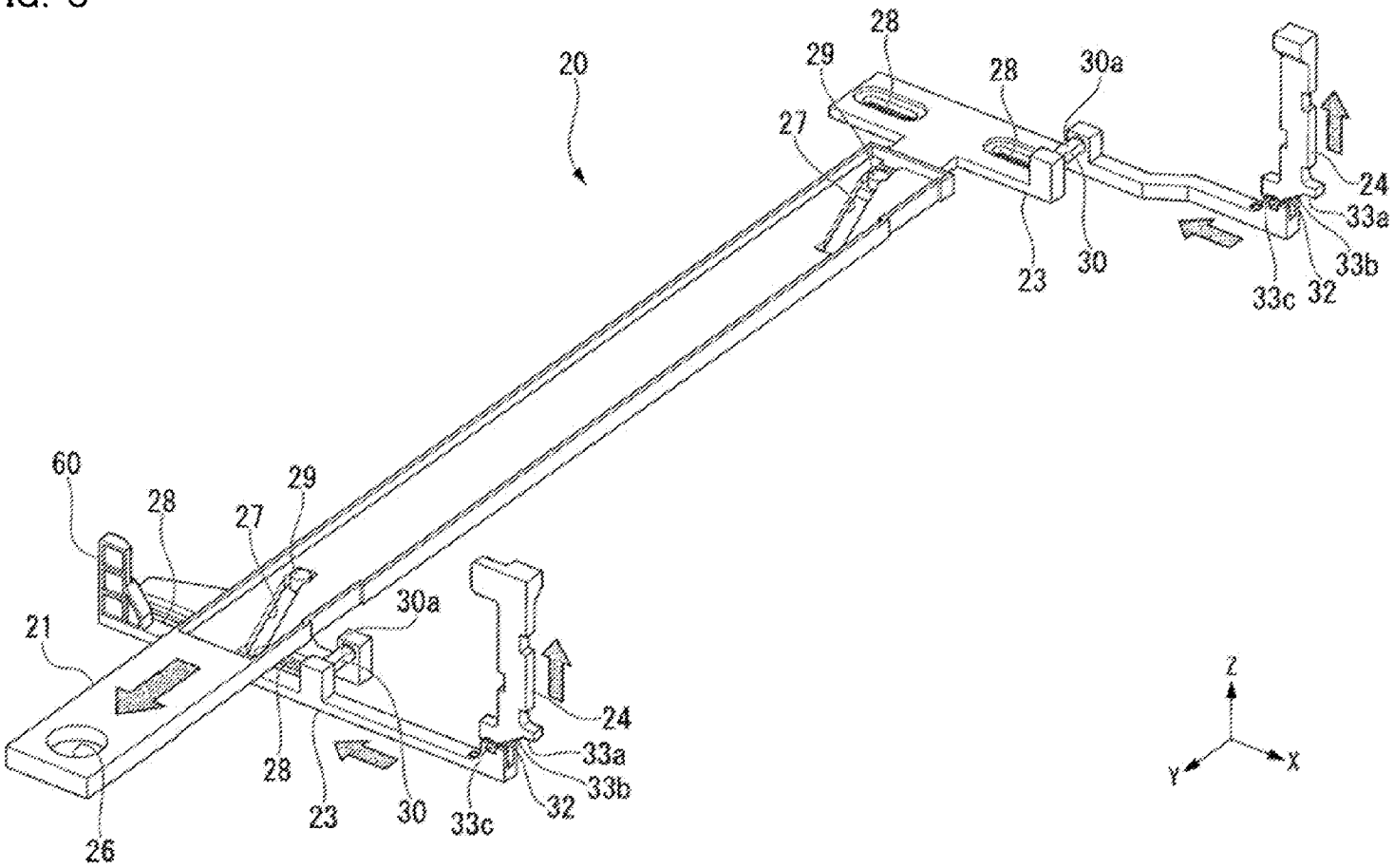
FIG. 6 is a perspective view showing the external appearance of the entire operation portion when it is located at the second position according to an embodiment of the present disclosure.
Figure 7:
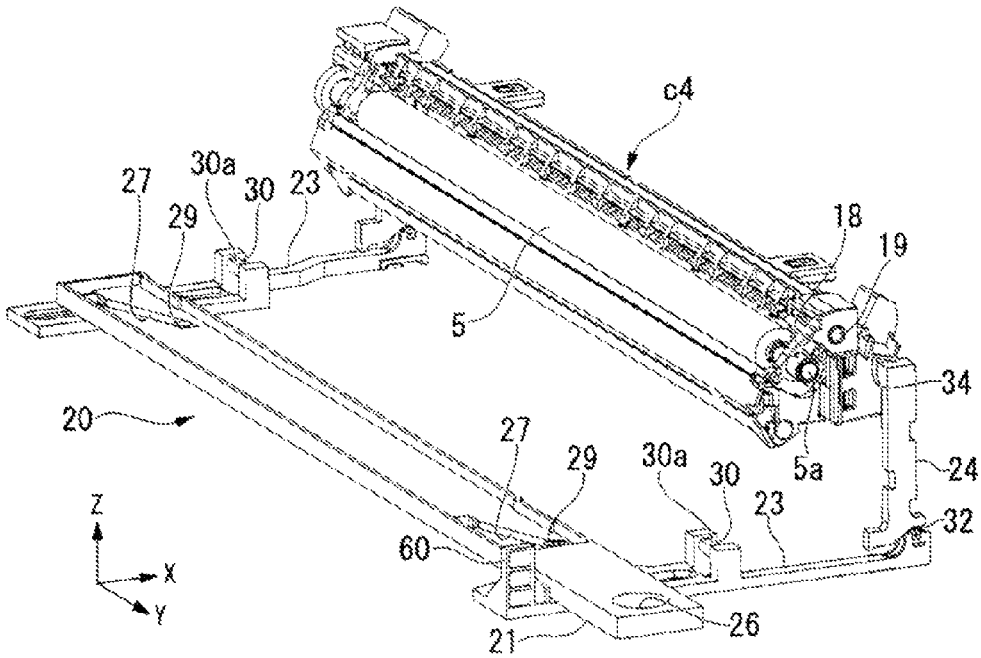
FIG. 7 is a perspective view showing the arrangement of a transfer unit with respect to the operation portion according to an embodiment of the present disclosure.

FIG. 3 is a configuration diagram showing the arrangement of various units when the operation portion 20 is located at a first position (retracted position) according to an embodiment of the present disclosure. FIG. 4 is a configuration diagram showing the arrangement of the units when the operation portion 20 is located at a second position (depressing position) according to an embodiment of the present disclosure. FIG. 5 is a perspective view showing the external appearance of the entire operation portion 20 when it is located at the first position according to an embodiment of the present disclosure. FIG. 6 is a perspective view showing the external appearance of the entire operation portion 20 when it is located at the second position according to an embodiment of the present disclosure. FIG. 7 is a perspective view showing the arrangement of the transfer unit c4 with respect to the operation portion 20 according to an embodiment of the present disclosure.

Figure 8:
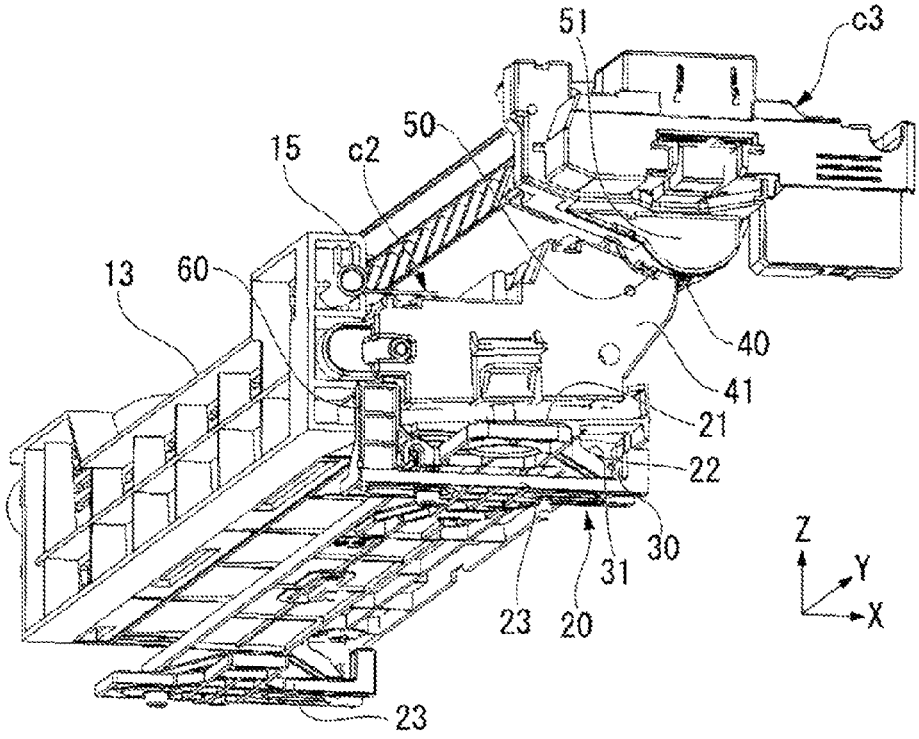
FIG. 8 is a perspective view showing the external appearance of a developing unit and a drum unit when the developing unit is located at a pressing position according to an embodiment of the present disclosure.
Figure 9:
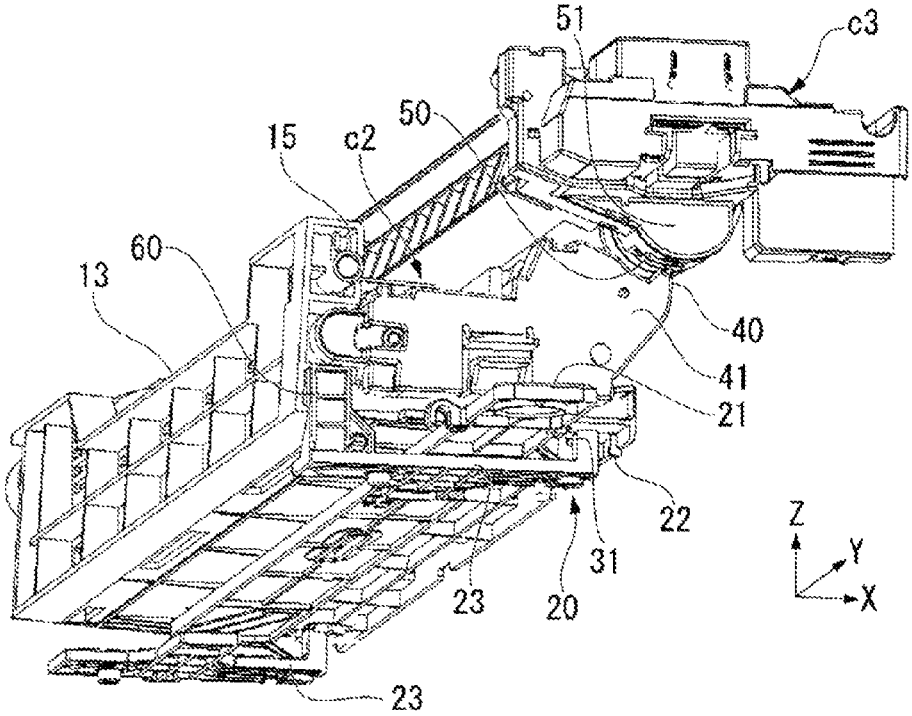
FIG. 9 is a perspective view showing the external appearance of the developing unit and the drum unit when the developing unit is located at a pressing-releasing position according to an embodiment of the present disclosure.
Figure 10:
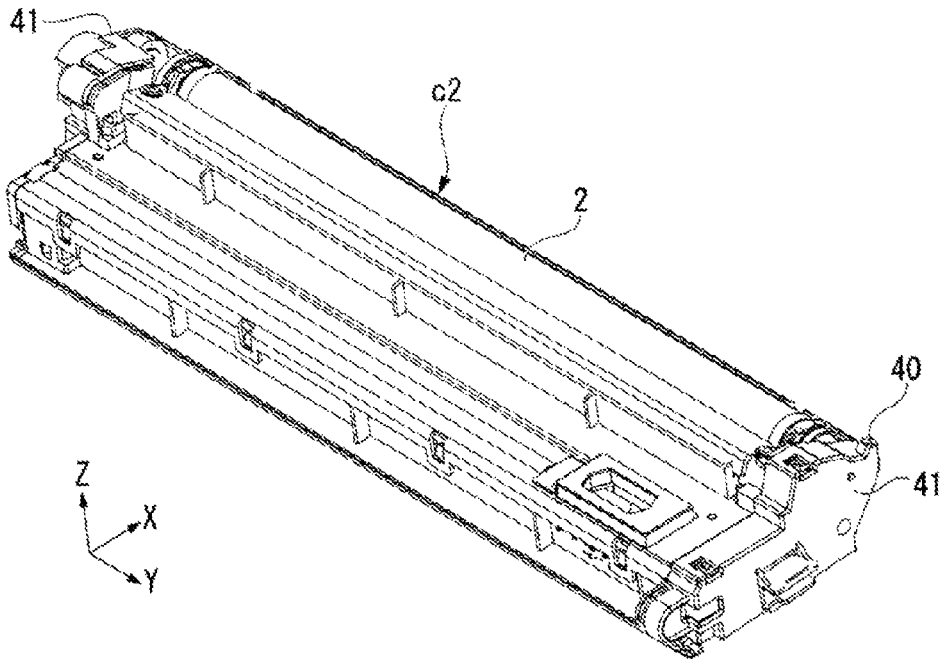
FIG. 10 is a perspective view showing the external appearance of the developing unit according to an embodiment of the present disclosure.
Figure 11:
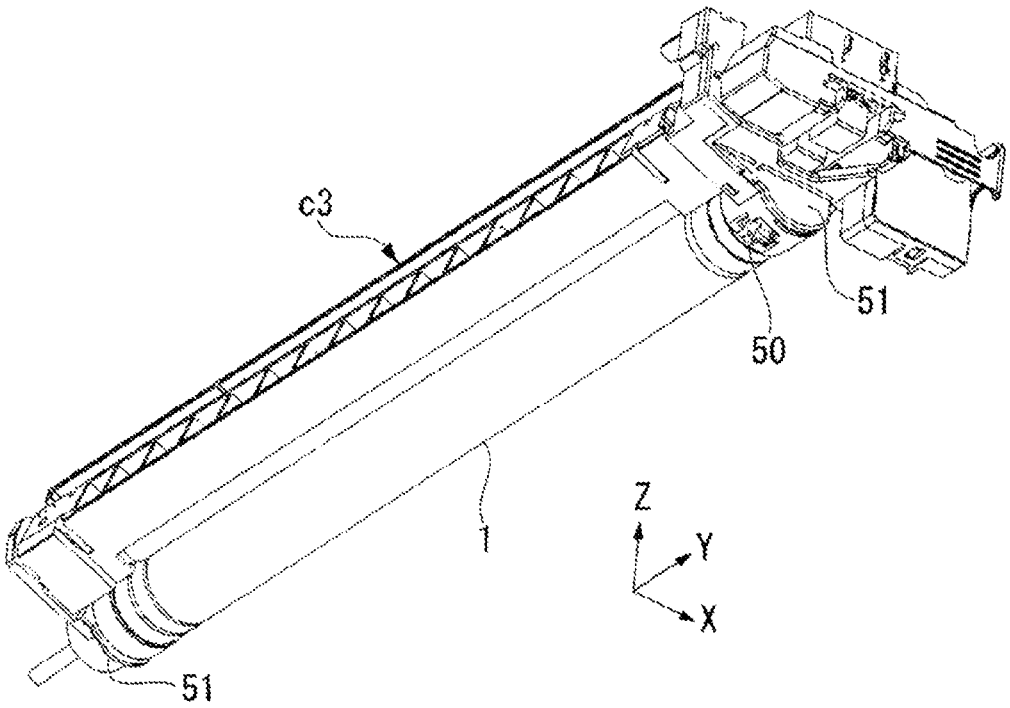
FIG. 11 is a perspective view showing the external appearance of the drum unit according to an embodiment of the present disclosure.
Figure 12:
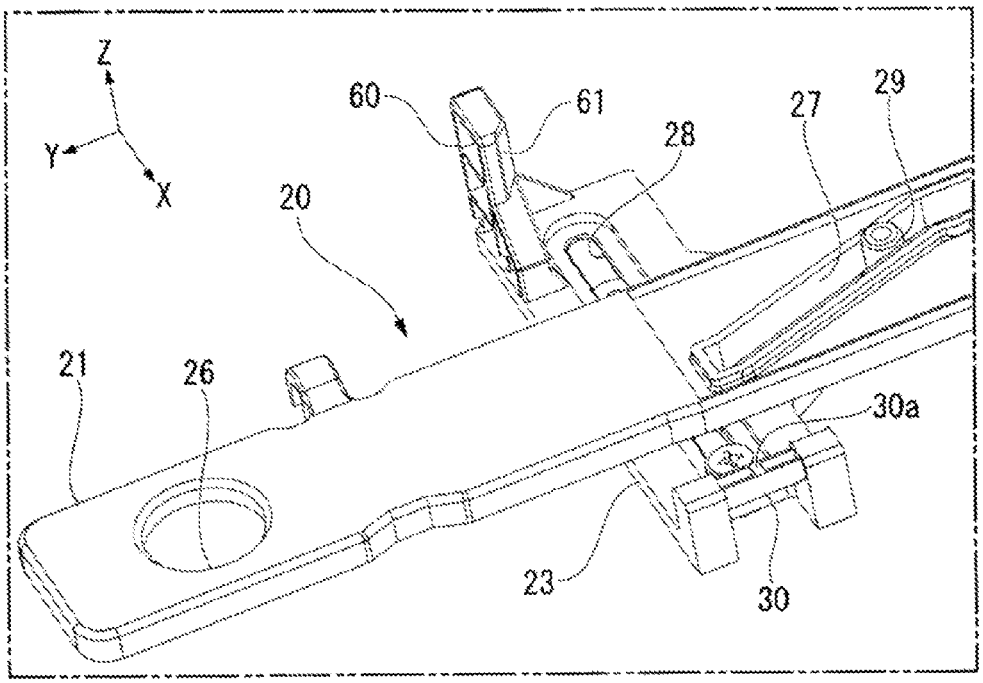
FIG. 12 is a perspective view showing the external appearance of a second projection portion provided in the operation portion according to an embodiment of the present disclosure.

FIG. 8 is a perspective view showing the external appearance of the developing unit c2 and the drum unit c3 when the developing unit c2 is located at a pressing position according to an embodiment of the present disclosure. FIG. 9 is a perspective view showing the external appearance of the developing unit c2 and the drum unit c3 when the developing unit c2 is located at a pressing-releasing position according to an embodiment of the present disclosure. FIG. 10 is a perspective view showing the external appearance of the developing unit c2 according to an embodiment of the present disclosure. FIG. 11 is a perspective view showing the external appearance of the drum unit c3 according to an embodiment of the present disclosure. FIG. 12 is a perspective view showing the external appearance of a second projection portion 60 provided at the operation portion 20 according to an embodiment of the present disclosure.

As shown in FIG. 3, when the drum unit c3 is attached to the apparatus body 10, the developing roller 2 of the developing unit c2 that develops a toner image and the transfer roller 5 of the transfer unit c4 that transfers the toner image on the photosensitive drum 1 onto the predetermined sheet material are disposed so as to be radially opposed to the photosensitive drum 1.

The developing unit c2 is mounted to a pressing unit 13. The pressing unit 13 includes rails 14 on which the developing unit c2 is mounted so as to be extractable in the same direction (the Y-axis direction) as the extraction direction of the drum unit c3. The pressing unit 13 is configured to make the developing unit c2 movable between a pressing position at which the developing roller 2 is pressed against the photosensitive drum 1 as shown in FIG. 3 and a pressing-releasing position at which the developing roller 2 is separated from the photosensitive drum 1 so as to release the pressing.

As shown in FIG. 3, the pressing unit 13 includes a pivot shaft (first shaft) 15 for pivoting the developing unit c2. The pivot shaft 15 is rotatably supported in a hole portion (not shown) of the apparatus body 10. Accordingly, the developing unit c2 is pivotable about the pivot shaft 15, which is a shaft extending in the extraction direction (Y-axis direction). A pressing spring (biasing portion) 16 is provided below the pressing unit 13. The pressing spring 16 is configured to bias the pressing unit 13 from the pressing-releasing position toward the pressing position.

The transfer roller 5 is provided so as to be movable between a second pressing position at which it is pressed against the photosensitive drum 1 as shown in FIG. 3 and a second pressing-releasing position at which it is separated from the photosensitive drum 1 so as to release the pressing as shown in FIG. 4. The transfer roller 5 is biased and pressed by a pressing spring (second biasing portion) 17 from the second pressing-releasing position toward the second pressing position. Note that the transfer unit c4 including the transfer roller 5 includes a lever member 18 that engages with a shaft 5*a* of the transfer roller 5. The lever member 18 includes a pivot shaft 19. Accordingly, the transfer roller 5 is pivotable about the pivot shaft 19, which is a shaft extending in the extraction direction (Y-axis direction).

The operation portion 20 is configured to cause the pressing unit 13 and the transfer roller 5 to move in conjunction with each other. The operation portion 20 is configured to be movable between a first position (retracted position) at which the pressing unit 13 is positioned at the pressing position and the transfer roller 5 is positioned at the second pressing position in conjunction with each other as shown in FIG. 3 and a second position (depressing position) at which the pressing unit 13 is positioned at the pressing-releasing position against the bias of the pressing spring 16 and the transfer roller 5 is positioned at a second pressing-releasing position against the bias of the pressing spring 17 in conjunction with each other as shown in FIG. 4.

The operation portion 20 includes an operating lever 21 that is drawable from the apparatus body 10, sliders 23 that cause the pressing unit 13 to pivot about the pivot shaft 15 in conjunction with movement of the operating lever 21, and lift members 24 that cause the transfer roller 5 to pivot about the pivot shaft 19 in conjunction with movement of the sliders 23.

As shown in FIG. 5, the operating lever 21 is a plate-like member extending in the depth direction (Y-axis direction) of the apparatus body 10. A gripping portion 26 is provided on the front side of the operating lever 21. As shown in FIGS. 5 and 6, the operating lever 21 is configured to be movable in the Y-axis direction by a guide (not shown). The operating lever 21 has slanting holes 27 extending in a direction intersecting the movement direction (Y-axis direction). The slanting holes 27 are provided on the front side (+Y-side) and the back side (−Y-side) so as to be parallel to each other. Each of the slanting holes 27 is configured to approach the left side (−X-side) toward the back side.

The sliders 23 are provided in a pair on the front side (+Y-side) and the back side (−Y-side) of the operating lever 21 so as to be parallel to each other. Each of the sliders 23 is provided below the operating lever 21. The slider 23 has a guide hole 28 extending in a direction (X-axis direction) orthogonal to the extraction direction. A pin (not shown) is inserted into the guide hole 28 and fixed to the apparatus body 10, so that the slider 23 is configured to be movable in the X-axis direction. Additionally, a pin 29 that is to be disposed in the slanting hole 27 of the operating lever 21 is provided upstanding on the slider 23.

Thus, when the operating lever 21 is extracted to the +Y-side as shown in FIG. 6, the pin 29 slides along the slanting hole 27, causing the slider 23 to move to the −X-side in conjunction with movement of the operating lever 21. Conversely, when the operating lever 21 is pushed into the −Y-side, the pin 29 slides along the slanting hole 27, causing the slider 23 to move to the +X-side in conjunction with movement of the operating lever 21 (see FIG. 5).

The slider 23 includes a shaft 30 that causes the pressing unit 13 to pivot about the pivot shaft 15 in conjunction with movement of the operating lever 21. The shaft 30 is provided in a bridging manner so as to extend in the Y-axis direction. As shown in FIG. 3, a hook 31 capable of engaging with the shaft 30 is provided integrally with the pressing unit 13 below the pressing unit 13. The hook 31 is inclined downward toward the +X-side.

When the operation portion 20 is located at the first position, the shaft 30 is prevented from engaging with the hook 31 as shown in FIG. 3. On the other hand, when the operation portion 20 is located at the second position, the shaft 30 engages with the hook 31 so as to depress the pressing unit 13 against the bias of the pressing spring 16 as shown in FIG. 4. That is, when the shaft 30 is moved to the −X-side, the developing unit c2 pivots about the pivot shaft 15 together with the pressing unit 13 so as to separate the developing roller 2 from the photosensitive drum 1, thereby releasing the pressed state.

As shown in FIG. 5, the slider 23 includes a support roller 32 at its end portion on the +X-side. The support roller 32 is supported rotatably about a shaft extending in the Y-axis direction. The support roller 32 is configured to support the lift member 24.

The lift member 24 is a bar-like member extending in the vertical direction (Z-axis direction). A pair of lift members 24 are provided parallel to each other on the front side (+Y-side) and the back side (−Y-side) so as to correspond to the sliders 23.

As shown in FIGS. 5 and 6, each of the lift members 24 is configured to be movable in the Z-axis direction by a guide (not shown). The lower edge of the lift member 24 is supported on the support roller 32 as shown in FIG. 3. The lower edge of the lift member 24 has a flat portion 33*a*, a sloped portion 33*b*, and an indented portion 33*c*. The flat portion 33*a* is located above the indented portion 33*c*, and the sloped portion 33*b* is provided between the flat portion 33*a* and the indented portion 33*c*.

As shown in FIG. 7, the lever member 18 includes abutting portions 34 projecting in the Y-axis direction (the abutting portion 34 on the back side (−Y-side) is not shown). The upper edge of each lift member 24 is provided at a position where it can come into contact with the abutting portion 34 of the lever member 18 in the Z-axis direction.

When the operation portion 20 is located at the first position, the flat portion 33*a* of the lift member 24 is supported on the support roller 32 as shown in FIG. 3. On the other hand, when the operation portion 20 is located at the second position, the indented portion 33*c* of the lift member 24 is supported on the support roller 32 as shown in FIG. 4 so as to cause the transfer roller 5 to pivot against the bias of the pressing spring 17.

That is, when the slider 23 moves to the −X-side, the support roller 32 rolls on the lower edge of the lift member 24, so that the supporting position moves from the flat portion 33*a* through the sloped portion 33*b* to the indented portion 33*c*. Then, the lift member 24 is moved to the +Z-side, and the upper edge of the lift member 24 lifts the abutting portion 34. This causes the transfer roller 5 to pivot about the pivot shaft 19 together with the lever member 18, and the transfer roller 5 is separated from the photosensitive drum 1, thereby releasing the pressed state.

Further, the developing unit c2 is provided with a projection portion 40 that is projected to the extraction path of the drum unit c3 when the developing unit c2 is located at the pressing position as shown in FIGS. 3 and 8, and is retracted from the extraction path of the drum unit c3 when the developing unit c2 is located at the pressing-releasing position as shown in FIGS. 4 and 9. Note that the drum unit c3 is mounted on rails (not shown) and configured to be extractable in the Y-axis direction. As shown in FIGS. 8 and 9, the projection portion 40 is provided integrally with a side frame 41 of the developing unit c2.

As shown in FIG. 10, the projection portion 40 is provided at a position of the developing unit c2 that corresponds to the front side (+Y-side) of the apparatus body 10. In other words, when the developing unit c2 is attached to the apparatus body 10, the projection portion 40 is located on the entrance side (the cover 11 side shown in FIG. 3) of the apparatus body 10. The projection portion 40 has a trapezoidal shape, and is provided so as to project obliquely upward at the upper edge portion of the developing unit c2 on the +X-side.

Further, the drum unit c3 is provided with a groove portion 50 that is fitted with the projection portion 40 when the developing unit c2 is located at the pressing position as shown in FIGS. 3 and 8, and releases the fitting with the projection portion 40 when the developing unit c2 is located at the pressing-releasing position as shown in FIGS. 4 and 9. As shown in FIGS. 8 and 9, the groove portion 50 is provided integrally with a side frame 51 of the drum unit c3.

As shown in FIG. 11, the groove portion 50 is provided at a position of the drum unit c3 that corresponds to the front side (+Y-side) of the apparatus body 10. In other words, when the drum unit c3 is attached to the apparatus body 10, the groove portion 50 is located at the entrance side of the apparatus body 10 (the cover 11 side shown in FIG. 3). The groove portion 50 has a trapezoidal shape corresponding to the shape of the projection portion 40, and is provided so as to be indented obliquely upward at the lower edge of the drum unit c3 on the −X-side.

That is, when the developing unit c2 is located at the pressing position, the projection portion 40 is projected to the extraction path of the drum unit c3, and is fitted with the groove portion 50, thereby causing the developing unit c2 and the drum unit c3 to be locked in the Y-axis direction and limiting the extraction of the units as shown in FIG. 8. On the other hand, when the developing unit c2 is located at the pressing-releasing position, the projection portion 40 is retracted from the extraction path of the drum unit c3 and is released from the fitting with the groove portion 50. This prevents the developing unit c2 and the drum unit c3 from being locked in the Y-axis direction, thereby releasing the limitation of the extraction of the unit as shown in FIG. 9.

Further, the pressing unit 13 is provided with depression limiting portions 22 that limit the depression of the pressing unit 13 when the operation portion 20 is located at the first position (retracted position) as shown in FIG. 3, and release the limitation of the depression of the pressing unit 13 when the operation portion 20 is located at the second position (depressing position) as shown in FIG. 4. The depression limiting portions 22 are provided integrally with the bottom portion (see FIG. 15 described below, the depression limiting portion 22 on the back side (−Y-side) is not shown) of the pressing unit 13.

As shown in FIG. 3, each of the depression limiting portions 22 is opposed to the shaft 30 of the slider 23 in the Z-axis direction when the operation portion 20 is located at the first position. The lower edge of the depression limiting portion 22 has a flat-plate shape. On the other hand, the operation portion 20 has an abutting surface 30*a* formed by flatly cutting the upper edge of the shaft 30 of the slider 23. The lower edge of the depression limiting portion 22 is disposed with a minute gap from the abutting surface 30*a*.

That is, when the operation portion 20 is located at the first position, the depression limiting portion 22 and the shaft 30 of the slider 23 are opposed in the Z-axis direction shown in FIG. 3. Thus, even if an attempt is made to depress the pressing unit 13, the depression limiting portion 22 and the shaft 30 abut against each other, thereby limiting the depression of the pressing unit 13. On the other hand, when the operation portion 20 is located at the second position, the depression limiting portion 22 and the shaft 30 of the slider 23 are not opposed in the Z-axis direction. Thus, the limitation of the depression of the pressing unit 13 is released as shown in FIG. 4.

Further, the operation portion 20 is provided with a second projection portion 60 that is projected to the extraction path of the developing unit c2 when the operation portion 20 is located at the first position as shown in FIG. 3, and is retracted from the extraction path of the developing unit c2 when the operation portion 20 is located at the second position as shown in FIG. 4. The second projection portion 60 is provided integrally with the slider 23 of the operation portion 20. As shown in FIG. 5, the second projection portion 60 is provided integrally with the slider 23 disposed on the front side (+Y-side) of the apparatus body 10.

The second projection portion 60 upstands at the end portion of the slider 23 on the −X-side. As shown in FIG. 12, the second projection portion 60 includes an inclined surface 61 for pushing the developing unit c2 into the back side of the apparatus body 10. The inclined surface 61 is disposed so as to face the +X-side and the −Y-side. That is, when the developing unit c2 is slightly incompletely inserted into the pressing unit 13, the inclined surface 61 abuts against the developing unit c2 so as to break down the force (the force directed toward the +X-side) acting on the slider 23 when the operation portion 20 moves from the second position to the first position into the force (the force directed toward the −Y-side) pushing the developing unit c2 into the back side of the apparatus body 10.

Next, a unit replacement operation in the copier P having the above-described configuration will be described.

In the case of removing the drum unit c3 or the developing unit c2 from the apparatus body 10, the user first opens a part of the cover 11 provided on the front side of the apparatus body 10 as shown in FIG. 2. When the cover 11 is opened, the operating lever 21 of the operation portion 20 is exposed on the front side of the apparatus body 10.

Next, the user moves the operation portion 20 from the first position to the second position by pulling the operating lever 21. Specifically, the user grasps the gripping portion 26 of the operating lever 21 so as to pull the operating lever 21 to the front side (+Y-side) of the apparatus body 10. When the operating lever 21 is pulled out, the operation portion 20 is displaced from the first position to the second position, making the drum unit c3 and the developing unit c2 extractable from the apparatus body 10.

More specifically, when the operating lever 21 is pulled out, the pins 29 engaged with the slanting holes 27 slide to the −X-side as shown in FIG. 6. This causes the sliders 23 to move to the −X-side in conjunction with movement of the operating lever 21. When the sliders 23 move to the −X-side, the shafts 30 engage with the hooks 31, thereby depressing the pressing unit 13 against the bias of the pressing springs 16 as shown in FIG. 4. When the pressing unit 13 is depressed, the developing unit c2 pivots about the pivot shaft 15, thereby separating the developing roller 2 from the photosensitive drum 1.

Further, when the sliders 23 move to the −X-side, the support rollers 32 roll on the lower edges of the lift members 24 so as to support the indented portions 33*c*. When the indented portions 33*c* are supported, the lift members 24 move to the +Z-side, and the upper edges of the lift members 24 depress the abutting portions 34. When the abutting portions 34 are lifted, the lever member 18 pivots about the pivot shaft 19, thereby separating the transfer roller 5 from the photosensitive drum 1 against the bias of the pressing spring 17.

Through the above-described operations, the user can freely extract one or both of the developing unit c2 and the drum unit c3 for which the pressed state has been released.

Meanwhile, in the case of attaching the developing unit c2 or the drum unit c3 to the apparatus body 10 after maintenance, the user inserts the developing unit c2 or the drum unit c3 into the apparatus body 10 in the Y-axis direction in a state in which the operating lever 21 is pulled. After insertion of the unit, the user pushes in the operating lever 21 so as to move the operation portion 20 from the second position to the first position.

Specifically, the user grasps the gripping portion 26 of the operating lever 21 and pushes in the operating lever 21 to the back side (−Y-side) of the apparatus body 10. When the operating lever 21 is pushed in, the pins 29 engaged with the slanting holes 27 slide to the +X-side as shown in FIG. 5. This causes the sliders 23 to move to the +X-side in conjunction with movement of the operating lever 21. When the sliders 23 move to the +X-side, the engagement between the shafts 30 and the hooks 31 is released, causing the pressing unit 13 to be lifted by the bias of the pressing spring 16 as shown in FIG. 3. When the pressing unit 13 is lifted, the developing unit c2 pivots about the pivot shaft 15, thereby bringing the developing roller 2 in close proximity to the photosensitive drum 1.

Further, when the sliders 23 move to the +X-side, the support rollers 32 roll on the lower edges of the lift members 24 so as to support the flat portions 33*a*. When the flat portions 33*a* are supported, the lift members 24 move to the −Z-side, thereby releasing the lifting of the abutting portions 34 by the upper edges of the lift members 24. When the lifting of the abutting portions 34 is released, the lever member 18 pivots about the pivot shaft 19, and the transfer roller 5 is brought in close proximity to the photosensitive drum 1 by the bias of the pressing spring 17.

Through the above-described operations, the user can attach one or both of the developing unit c2 and the drum unit c3 to the apparatus body 10, and restore each of the developing roller 2 and the transfer roller 5 to its original position that has been positioned with respect to the photosensitive drum 1.

Next, with reference to FIGS. 13A to 16B, a description will be given of the function of preventing any erroneous operation that is non-compliant with the above-described regular operating procedure regarding the unit replacement operation for the copier P having the above-described configuration. Note that it is also conceivable to prevent erroneous operations by newly adding a separate erroneous operation prevention mechanism to the copier P. However, at the time of attaching or detaching the drum unit c3 or the developing unit c2, it will be necessary, for example, to operate the unit separation mechanism after releasing the erroneous operation prevention mechanism, so that time and trouble will be required for the unit detachment operation. Furthermore, when an erroneous operation prevention mechanism is newly added, extra members will be required, resulting in an increase in the manufacturing cost.

Figure 15A:
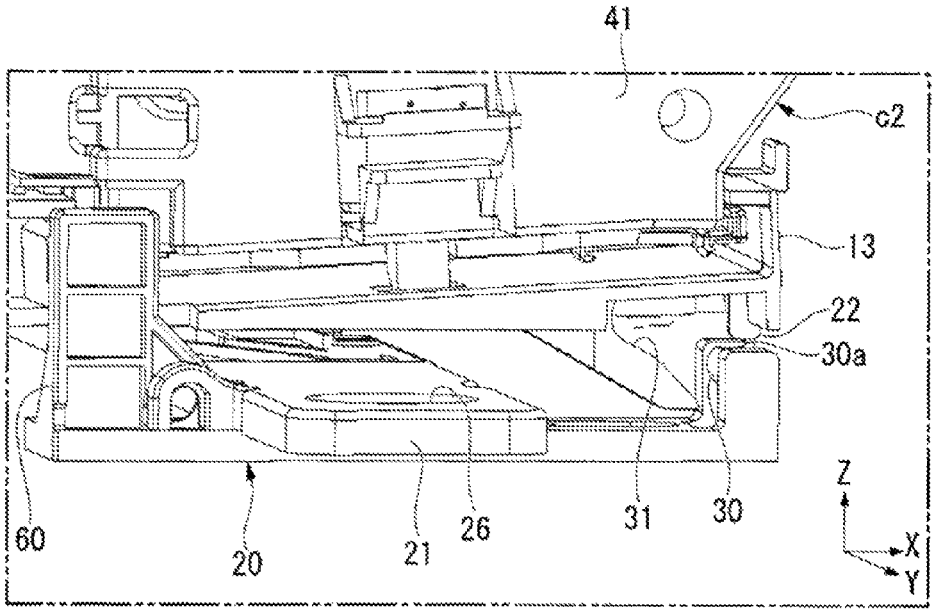
FIGS. 15A and 15B are diagrams for illustrating the function of a depression limiting portion according to an embodiment of the present disclosure.
Figure 15B:
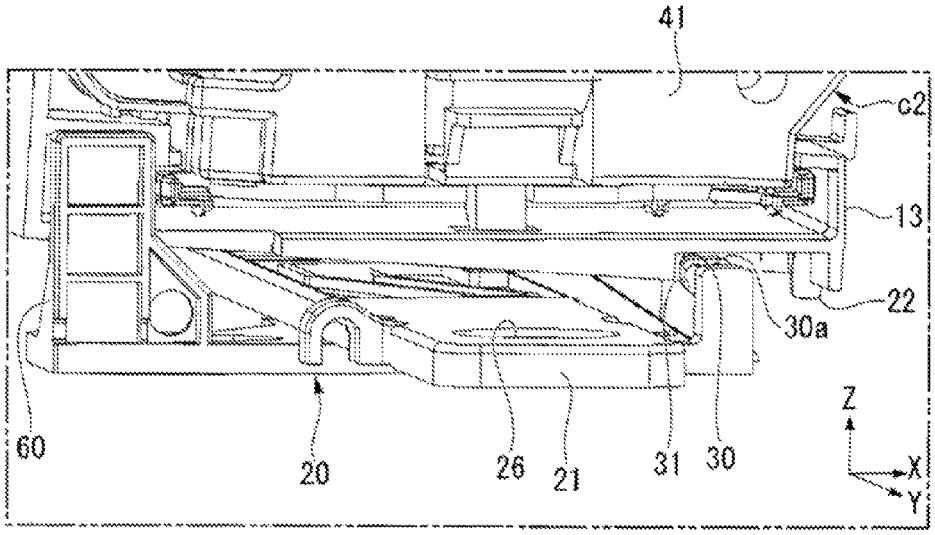
Figure 16A:
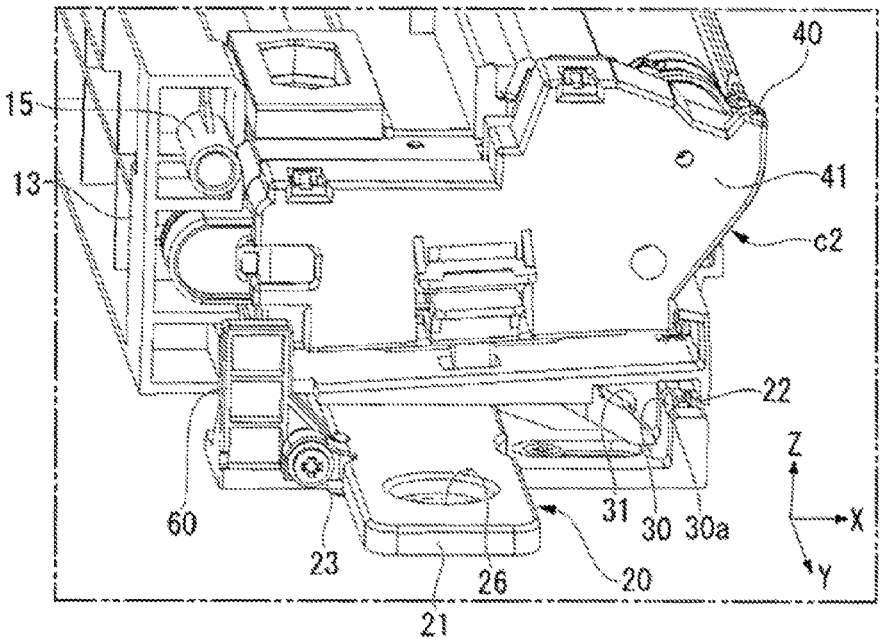
FIGS. 16A and 16B are diagrams for illustrating the function of the second projection portion according to an embodiment of the present disclosure.
Figure 16B:
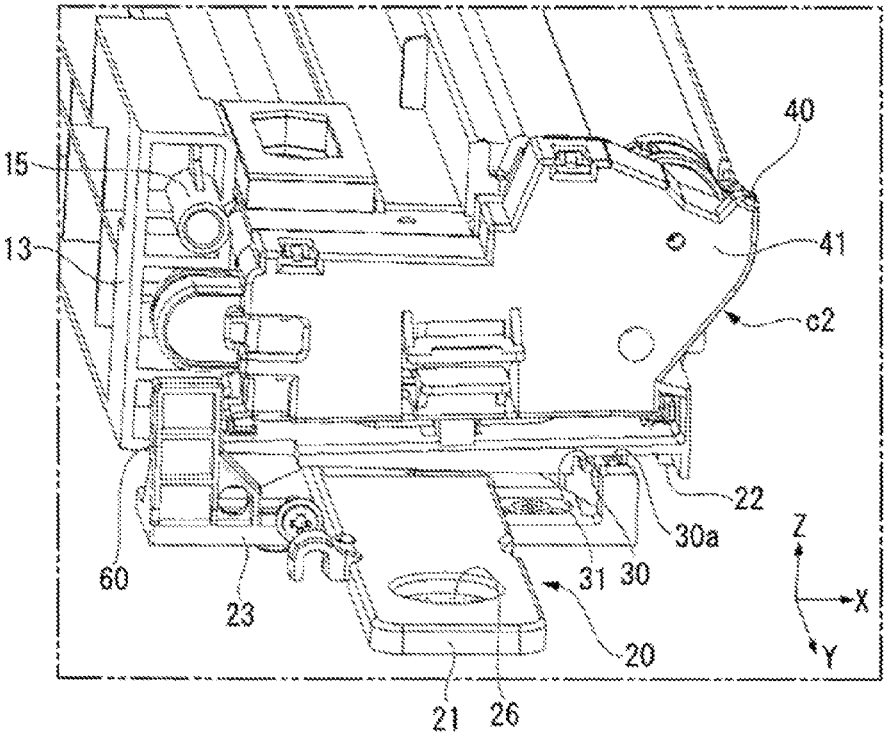

FIGS. 13A,13B,14A, and 14B are diagrams for illustrating the function of the projection portion 40 according to an embodiment of the present disclosure. FIGS. 15A and 15B are diagrams for illustrating the function of the depression limiting portion 22 according to an embodiment of the present disclosure. FIGS. 16A and 16B are diagrams for illustrating the function of the second projection portion 60 according to an embodiment of the present disclosure.

First, as an example of the user erroneous operation, a case is assumed where the user tries to extract the developing unit c2 or the drum unit c3 without pulling the operating lever 21.

Figure 13A:
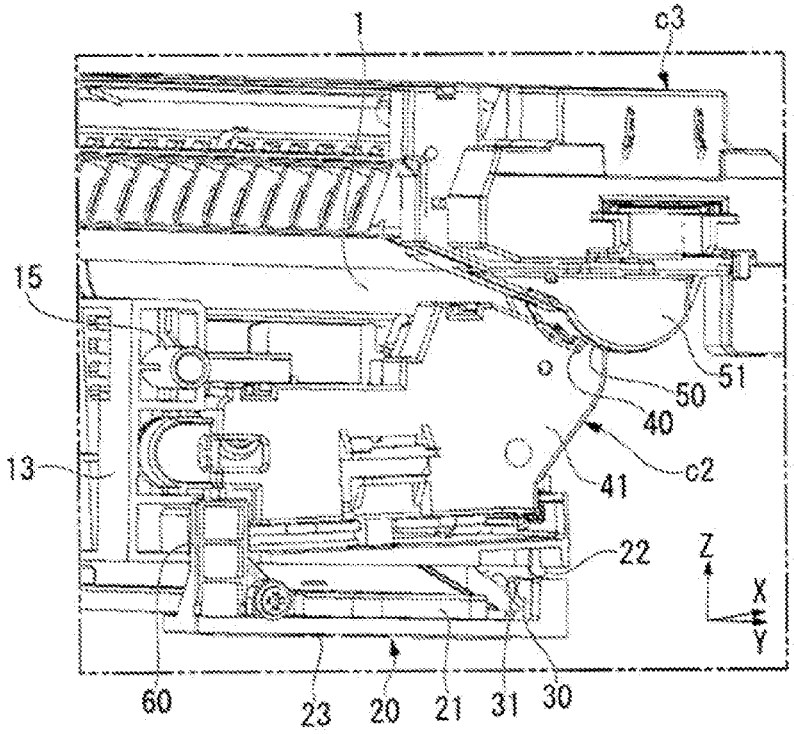
FIGS. 13A and 13B are diagrams for illustrating the function of a projection portion according to an embodiment of the present disclosure.

In the present embodiment, the developing unit c2 is provided with the projection portion 40, and the projection portion 40 is projected to the extraction path of the drum unit c3 when the developing unit c2 is located at the pressing position as shown in FIG. 13A. Thus, even if the user tries to extract the drum unit c3 in a state in which the developing unit c2 is not separated, the extraction of the drum unit c3 is prevented by the projection portion 40, and it is therefore possible to prevent the circumferential surface of the photosensitive drum 1 from being scratched as a result of this erroneous operation.

Furthermore, in the present embodiment, when the developing unit c2 is located at the pressing position shown in FIG. 13A, the projection portion 40 of the developing unit c2 is fitted with the groove portion 50 provided in the drum unit c3. Thus, even if the user tries to extract the developing unit c2 this time in a state in which the developing unit c2 is not separated, the extraction of the developing unit c2 is prevented by the fitting between the projection portion 40 and the groove portion 50, and it is therefore possible to prevent the circumferential surface of the photosensitive drum 1 from being scratched as a result of this erroneous operation.

Figure 13B:
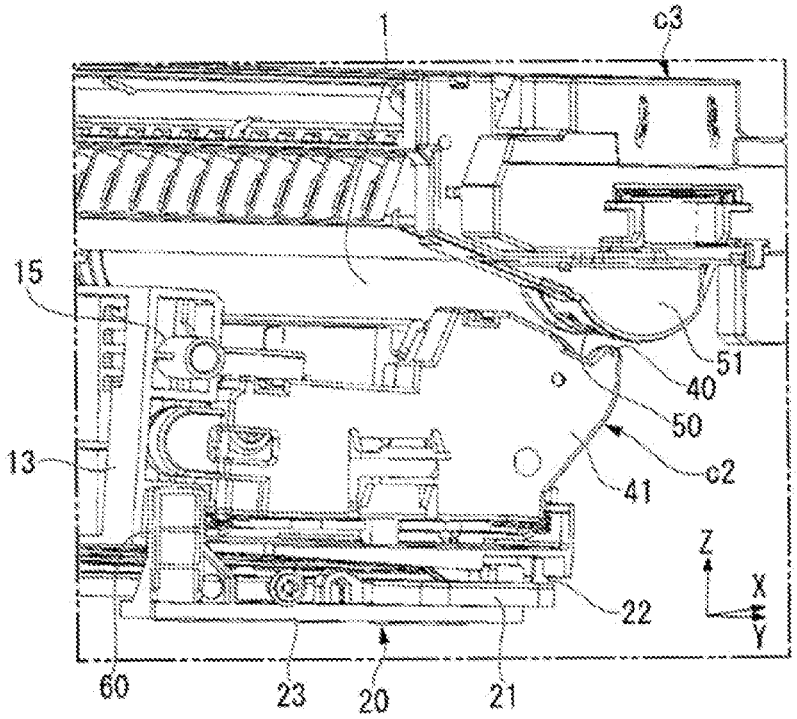

On the other hand, when the developing unit c2 is located at the pressing-releasing position as shown in FIG. 13B, the fitting between the projection portion 40 and the groove portion 50 is released, and the projection portion 40 is retracted from the extraction path of the drum unit c3 and thus will not prevent the extraction of the developing unit c2 or the drum unit c3.

Next, as an example of the user erroneous operation, a case is assumed where the user tries to insert the drum unit c3 without pulling the operating lever 21.

Figure 14A:
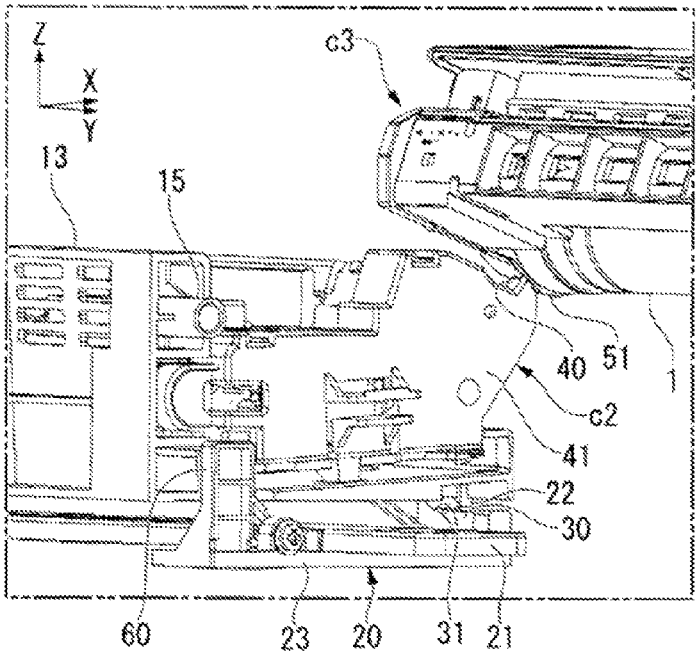
FIGS. 14A and 14B are diagrams for illustrating the function of the projection portion according to an embodiment of the present disclosure.
Figure 14B:
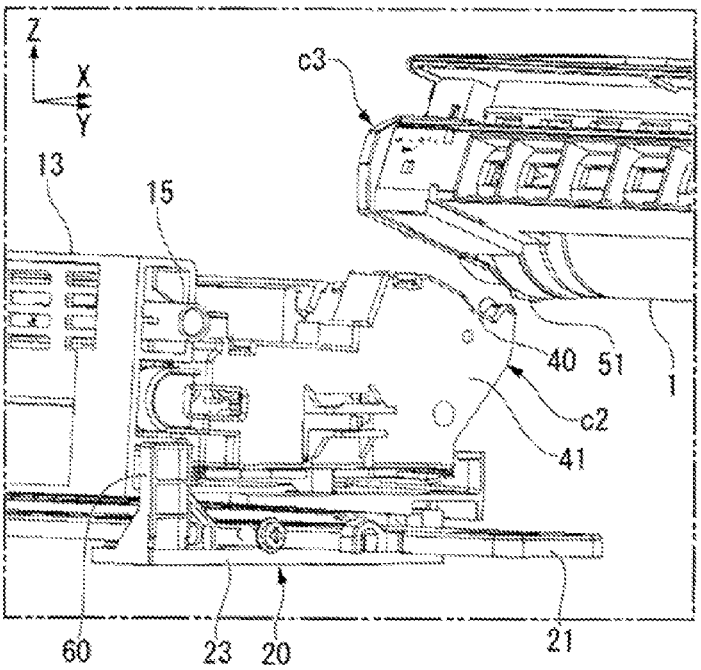

In the present embodiment, the developing unit c2 is provided with the projection portion 40 as described above, and the projection portion 40 is projected to the extraction path of the drum unit c3 as shown in FIG. 14A. Thus, even if the user tries to insert the drum unit c3 in a state in which the developing unit c2 is not separated, the side frame 51 abuts against the projection portion 40, and it is therefore possible to prevent the circumferential surface of the photosensitive drum 1 from being scratched as a result of this erroneous operation. Furthermore, in the present embodiment, the projection portion 40 is provided on the front side (+Y-side) of the apparatus body 10, and therefore, the insertion of the drum unit c3 in a state in which the developing unit c2 is not separated can be stopped at the entrance On the other hand, when the developing unit c2 is located at the pressing-releasing position as shown in FIG. 14B, the projection portion 40 is retracted from the extraction path of the drum unit c3 and therefore will not prevent the insertion of the drum unit c3.

Next, as an example of the user erroneous operation, a case is assumed where the user tries to extract the drum unit c3 by manually depressing the pressing unit 13, without pulling the operating lever 21.

In the present embodiment, the pressing unit 13 is provided with the depression limiting portions 22, and the lower edge of each depression limiting portion 22 is opposed to the shaft 30 of the slider 23 in the Z-axis direction as shown in FIG. 15A. Thus, even if the user tries to depress the pressing unit 13 without pulling the operating lever 21, the depression limiting portion 22 and the shaft 30 abut against each other. Accordingly, the depression of the pressing unit 13 is limited, and the projection portion 40 remains projecting to the extraction path of the drum unit c3. Therefore, the extraction of the drum unit c3 is prevented by the projection portion 40, thereby making it possible to prevent the circumferential surface of the photosensitive drum 1 from being scratched as a result of this erroneous operation.

On the other hand, when the operating lever 21 is pulled and the operation portion 20 is located at the second position as shown in FIG. 15B, the shaft 30 is retracted from the area below the depression limiting portion 22, and the depression limiting portion 22 therefore will not limit the depression of the pressing unit 13.

Next, as an example of the user erroneous operation, a case is assumed where the user pushes in the operating lever 21 after replacement of the developing unit c2, with the developing unit c2 being incompletely inserted.

In the present embodiment, the operation portion 20 is provided with the second projection portion 60, and the second projection portion 60 is projected to the extraction path of the developing unit c2 when the operation portion 20 is located at the first position as shown in FIG. 16A. Accordingly, even if the user tries to push in the operating lever 21 when the developing unit c2 is incompletely inserted in the pressing unit 13, the second projection portion 60 and the developing unit c2 abut against each other and the operation portion 20 will not operate. Thus, the user can be made aware that the developing unit c2 is incompletely inserted, and it is therefore possible to prevent the developing unit c2 from being erroneously attached.

Furthermore, in the present embodiment, the second projection portion 60 is provided with the inclined surface 61 as shown in FIG. 12. Accordingly, when the developing unit c2 is slightly incompletely inserted in the pressing unit 13 as shown in FIG. 16A, pushing in the operating lever 21 causes the inclined surface 61 and the developing unit c2 to abut each other, thereby making it possible to push in the developing unit c2 into the back side (−Y-side) of the apparatus body 10. Thus, the developing unit c2 can be attached at its regular position when the developing unit c2 is slightly incompletely inserted in the pressing unit 13.

Due to the presence of the second projection portion 60, the extraction of the developing unit c2 can be prevented by the second projection portion 60 as shown in FIG. 16A even if the user tries to extract the developing unit c2 in a state in which the pressing unit 13 is not depressed. Thus, it is possible to prevent the circumferential surface of the photosensitive drum 1 from being scratched as a result of this erroneous operation.

Due to the presence of the second projection portion 60, even if the user tries to insert the developing unit c2 in a state in which the pressing unit 13 is not depressed, the developing unit c2 abuts against the second projection portion 60, and it is therefore possible to prevent the circumferential surface of the photosensitive drum 1 from being scratched as a result of this erroneous operation. Furthermore, in the present embodiment, the second projection portion 60 is provided on the front side (+Y-side) of the apparatus body 10, and therefore the insertion of the developing unit c2 in a state in which the pressing unit 13 is not depressed can be stopped at the entrance.

In the present embodiment, the above-described configuration for preventing erroneous operations is provided integrally with the units and the unit separation mechanism. Specifically, the projection portion 40 is provided integrally with the developing unit c2. The groove portion 50 is provided integrally with the drum unit c3. The depression limiting portions 22 are provided integrally with the pressing unit 13. The second projection portion 60 is provided integrally with the operation portion 20. Accordingly, in the present embodiment, it is possible to prevent erroneous operations by using the operation for separating the developing unit c2 and the movements of the operation portion 20 during that operation, without providing extra members.

As described above, according to the present embodiment, it is possible to provide a copier P capable of preventing erroneous operations during attachment and detachment of units, without providing extra members.

While a preferred embodiment of the present disclosure has been described above with reference to the drawings, the present disclosure is not limited to the embodiment shown above. Various shapes, combinations and the like of the components shown in the above-described embodiment are merely examples, and various changes may be made depending on design requirements or the like without departing from the gist of the present disclosure.

For example, although the configuration in which the projection portion of the developing unit and the groove portion of the drum unit are fitted with each other is described in the above embodiment, the present disclosure is not limited to this configuration. It is possible to prevent the extraction of the developing unit in a state in which the developing unit is not separated, without providing the groove portion of the drum unit, as long as the second projection portion of the operation portion is provided. Conversely, it is possible to prevent the extraction of the developing unit in a state in which the developing unit is not separated, without providing the second projection portion of the operation portion, as long as the groove portion of the drum unit is provided.

Furthermore, for example, although the configuration in which the separation of the developing roller and the separation of the transfer roller from the photosensitive drum are performed in conjunction with each other by operating the operation portion is described in the above embodiment, the present disclosure is not limited to this configuration. For example, the transfer roller may be separated by using another mechanism.

For example, although a copier is described in the above embodiment as an exemplary image forming apparatus, the present disclosure is also applicable, for example, to an image forming apparatus such as a printer, a facsimile apparatus or the like.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a drum unit configured to be extractable from an apparatus body and including a photosensitive drum;

a developing unit configured to be extractable from the apparatus body and including a developing roller that develops a toner image on the photosensitive drum;

a pressing unit configured to make the developing unit movable between a pressing position at which the developing roller is pressed against the photosensitive drum and a pressing-releasing position at which the developing roller is separated from the photosensitive drum so as to release the pressing;

a projection portion provided integrally with the developing unit and configured to be projected to an extraction path of the drum unit when the developing unit is located at the pressing position and to retract from the extraction path of the drum unit when the developing unit is located at the pressing-releasing position;

a biasing portion configured to bias the pressing unit from the pressing-releasing position toward the pressing position;

an operation portion configured to be movable between a depressing position at which the operation portion depresses the pressing unit from the pressing position to the pressing-releasing position against the bias and a retracted position at which the operation portion retracts from the depressing position; and a depression limiting portion configured to limit the depression of the pressing unit when the operation portion is located at the retracted position and to release the limitation of the depression of the pressing unit when the operation portion is located at the depressing position.

2. The image forming apparatus according to claim 1, wherein the projection portion is provided on a front side of the apparatus body.

3. The image forming apparatus according to claim 1, further comprising a groove portion provided integrally with the drum unit and configured to be fitted with the projection portion when the developing unit is located at the pressing position and to release the fitting with the projection portion when the developing unit is located at the pressing-releasing position.

4. The image forming apparatus according to claim 1, wherein the depression limiting portion is provided integrally with the pressing unit and limits the depression of the pressing unit by abutting against the operation portion.

5. An image forming apparatus comprising:

a drum unit configured to be extractable from an apparatus body and including a photosensitive drum;

a developing unit configured to be extractable from the apparatus body and including a developing roller that develops a toner image on the photosensitive drum;

a pressing unit configured to make the developing unit movable between a pressing position at which the developing roller is pressed against the photosensitive drum and a pressing-releasing position at which the developing roller is separated from the photosensitive drum so as to release the pressing;

a projection portion provided integrally with the developing unit and configured to be projected to an extraction path of the drum unit when the developing unit is located at the pressing position and to retract from the extraction path of the drum unit when the developing unit is located at the pressing-releasing position;

a biasing portion configured to bias the pressing unit from the pressing-releasing position toward the pressing position;

an operation portion configured to be movable between a depressing position at which the operation portion depresses the pressing unit from the pressing position to the pressing-releasing position against the bias and a retracted position at which the operation portion retracts from the depressing position; and a second projection portion provided integrally with the operation portion and configured to be projected to an extraction path of the developing unit when the operation portion is located at the retracted position and to be retracted from the extraction path of the developing unit when the operation portion is located at the depressing position.

6. The image forming apparatus according to claim 5, wherein the second projection portion is provided on a front side of the apparatus body.

7. The image forming apparatus according to claim 6, wherein the second projection portion has an inclined surface configured to push the developing unit into a back side of the apparatus body.

* * * * *